US008708154B1

(12) United States Patent
Holmberg

(10) Patent No.: US 8,708,154 B1
(45) Date of Patent: Apr. 29, 2014

(54) ADJUSTABLE SPRING GRIZZLY BAR MATERIAL SEPARATOR

(76) Inventor: Tim Holmberg, Glendale, AZ (US)

( * ) Notice: Subject to any disclaimer, the term of this patent is extended or adjusted under 35 U.S.C. 154(b) by 99 days.

(21) Appl. No.: 13/336,349

(22) Filed: Dec. 23, 2011

(51) Int. Cl.
*B07B 1/49* (2006.01)

(52) U.S. Cl.
USPC ..... 209/394; 209/393; 209/395; 209/615

(58) Field of Classification Search
USPC ..... 209/393–395, 615
See application file for complete search history.

(56) References Cited

U.S. PATENT DOCUMENTS

| | | | | |
|---|---|---|---|---|
| 760,590 | A | 5/1904 | Vodra | |
| 886,247 | A | 4/1908 | Rechtenbach | |
| 1,136,674 | A | 4/1915 | Houston | |
| 1,187,238 | A | 6/1916 | Beaumont | |
| 1,606,301 | A | 11/1926 | Jones | |
| 1,982,244 | A * | 11/1934 | Davis | 209/393 |
| 1,997,713 | A * | 4/1935 | Boehm | 209/393 |
| 3,221,877 | A | 12/1965 | Koning | |
| 3,506,118 | A | 4/1970 | Illuzzi | |
| 3,572,505 | A | 3/1971 | Jongbloed | |
| 4,221,306 | A | 9/1980 | Althoff | |
| 4,361,240 | A | 11/1982 | Davis et al. | |
| 4,693,379 | A | 9/1987 | Stehle | |
| 4,956,078 | A | 9/1990 | Magerowski et al. | |
| 5,117,983 | A | 6/1992 | Marrs | |
| 5,219,078 | A | 6/1993 | Hadden | |
| 5,322,170 | A * | 6/1994 | Hadden | 209/314 |
| RE35,331 | E * | 9/1996 | Sherman | 209/393 |
| 5,816,412 | A * | 10/1998 | Bokor | 209/326 |
| 5,901,857 | A | 5/1999 | Schurman | |
| 6,041,943 | A * | 3/2000 | Gifford | 209/394 |
| 6,098,811 | A | 8/2000 | Schaefer | |
| 6,116,428 | A * | 9/2000 | Loshe | 209/319 |
| 6,336,560 | B1 | 1/2002 | Schaefer | |
| 7,011,217 | B2 | 3/2006 | Hanisch et al. | |
| 7,066,275 | B1 | 6/2006 | Keigley | |
| 7,383,957 | B2 | 6/2008 | Cox | |
| 7,850,010 | B2 | 12/2010 | Takev | |
| 2002/0056668 | A1 * | 5/2002 | Dube et al. | 209/421 |
| 2007/0278137 | A1 * | 12/2007 | Takev | 209/395 |
| 2008/0110807 | A1 * | 5/2008 | Goguen | 209/394 |
| 2009/0226662 | A1 | 9/2009 | Dyczko-Riglin et al. | |
| 2010/0326975 | A1 | 12/2010 | Palo et al. | |

* cited by examiner

*Primary Examiner* — Prasad Gokhale
(74) *Attorney, Agent, or Firm* — Schmeiser, Olsen & Watts LLP

(57) ABSTRACT

An adjustable spring grizzly bar material separator provided and includes a plurality of flexible tines, a cassette, wherein the plurality of flexible tines are each coupled on an end to the cassette, and a first set of spacers removably coupled within the cassette between the plurality of tines, wherein the first set of spacers separate the plurality of flexible tines a first predetermined distance to set the size of material that is to be separated from an amount of aggregate flowing over the tines. The material separator may also include a second set of spacers; the first set of spacers is replaceable with the second set of spacers, wherein the second set of spacers separates the plurality of flexible tines a second predetermined distance, the second predetermined distance being different from the first predetermined distance.

15 Claims, 12 Drawing Sheets

ADJUSTABLE SPRING GRIZZLY BAR MATERIAL SEPARATOR

BACKGROUND OF THE INVENTION

1. Technical Field

This invention relates generally to a grizzly bar material separator and more particularly to an adjustable spring grizzly bar material separator.

2. State of the Art

Material separators are commonly used in the aggregate industry. Material separators often referred to as vibrating grizzly feeders and are used for the purpose of separating material having different sizes. This is commonly performed by forcing material over a set of spaced apart bars, wherein the larger, oversized rock are separated from fines (finer particles) from a crusher feed source.

Conventional separators have a vibratory feeder that feeds material dumped onto it over a set of bars, wherein the bars are set in a fixed spacing. The bars are rigid and allow for little or no play. As the material is forced over the bars, the smaller particles pass through the spaces of the bars to a first location, and the larger material passes over the bars and is distributed to a second location.

These conventional separators have their limitations. First, the spaces between the bars are fixed and require changing the entire set of bars in order to provide for a different space to separate material of a different size. Additionally, rocks and debris often are lodged in the spaces between bars and thereby reduce efficiency of operation of the material separator. Additionally, frequent maintenance is required in order to check for obstructions like this and to further clean out and remove the obstructions. This requires additional man power and time to ensure the material separator is functioning in the most efficient manner possible.

Other devices are known, such as those described in U.S. Pat. Nos. 7,383,957; 6,116,428; 5,816,412; and 4,361,240. However, these patents disclose separators that have similar limitations.

Accordingly, there is a need in the field of grizzly bar material separators for an improved grizzly bar material separator that overcomes at least the limitations as discussed above.

DISCLOSURE OF THE INVENTION

The present invention relates to an adjustable spring grizzly bar material separator having a plurality of flexible tines, wherein the spacing between the tines is adjustable. The flexible tines inhibit the opportunity for material, such as rocks, to become lodged or otherwise stuck in the spaces between tines and obstruct the operation of the material separator.

An embodiment of the present invention includes an adjustable spring grizzly bar material separator. The material separator comprises a plurality of flexible tines; a cassette, wherein the plurality of flexible tines are each coupled on an end to the cassette; and a plurality of spacers coupled within the cassette between the plurality of flexible tines, wherein the spacers separate the plurality of flexible tines a predetermined distance to set the size of material that is to be separated from an amount of aggregate flowing over the tines.

Another embodiment of the present invention includes an adjustable spring grizzly bar material separator. The material separator comprises a plurality of flexible tines; a cassette, wherein the plurality of flexible tines are each coupled on an end to the cassette; and a first set of spacers removably coupled within the cassette between the plurality of flexible tines, wherein the first set of spacers separate the plurality of flexible tines a first predetermined distance to set the size of material that is to be separated from an amount of aggregate flowing over the tines. The embodiment may also comprise a second set of spacers, wherein the first set of spacers is replaceable with the second set of spacers, wherein the second set of spacers separates the plurality of flexible tines a second predetermined distance, the second predetermined distance being different from the first predetermined distance.

In other embodiments, the flexible tines flex in spring like fashion in each direction. In these embodiments, the flexible tines flex in response to force applied to the flexible tines from ongoing material flow over the tines, wherein the flex in the flexible tines inhibits collection material between adjacent flexible tines.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
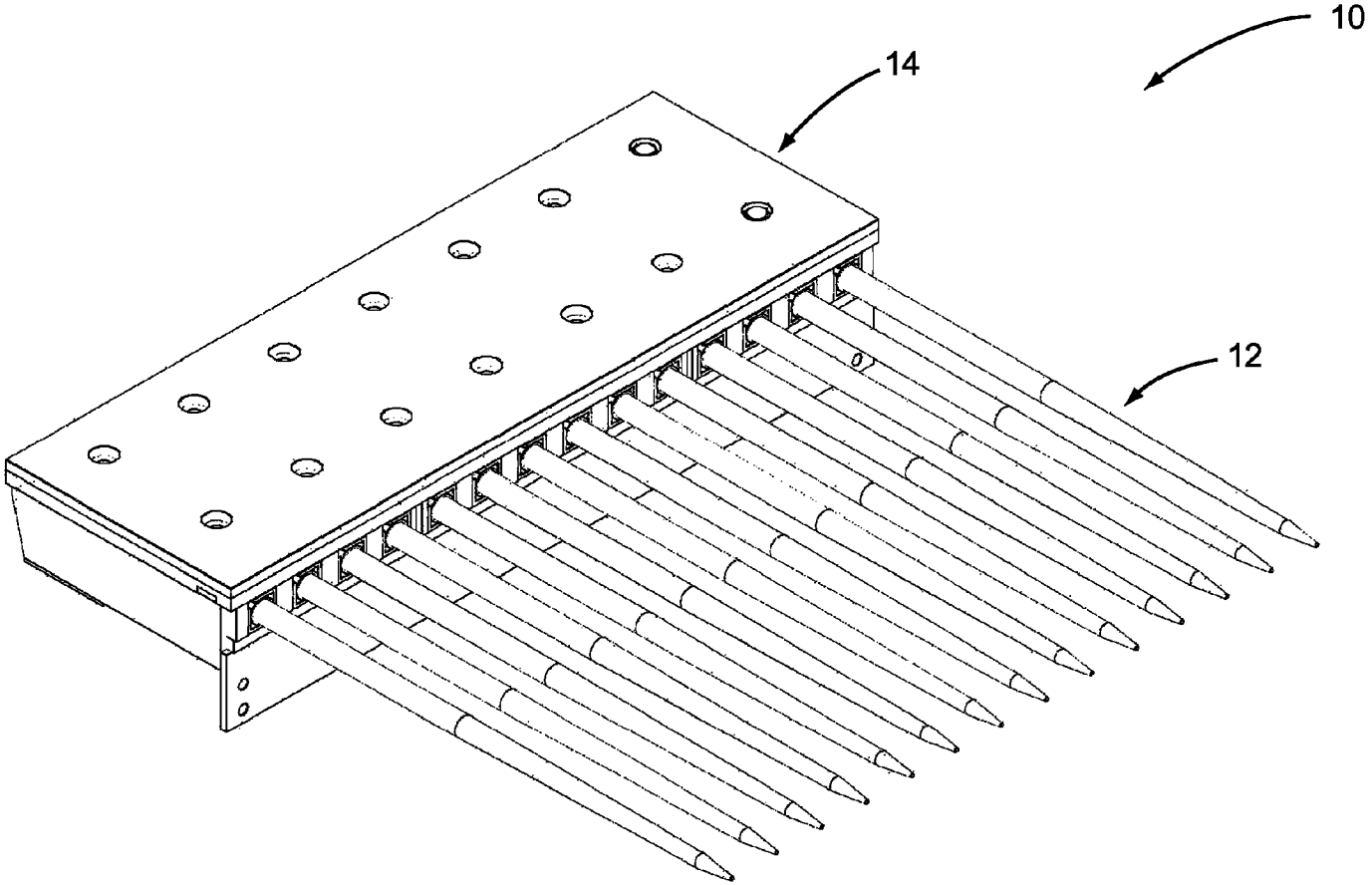
FIG. 1 is a perspective view of an adjustable spring grizzly bar material separator.
Figure 2:
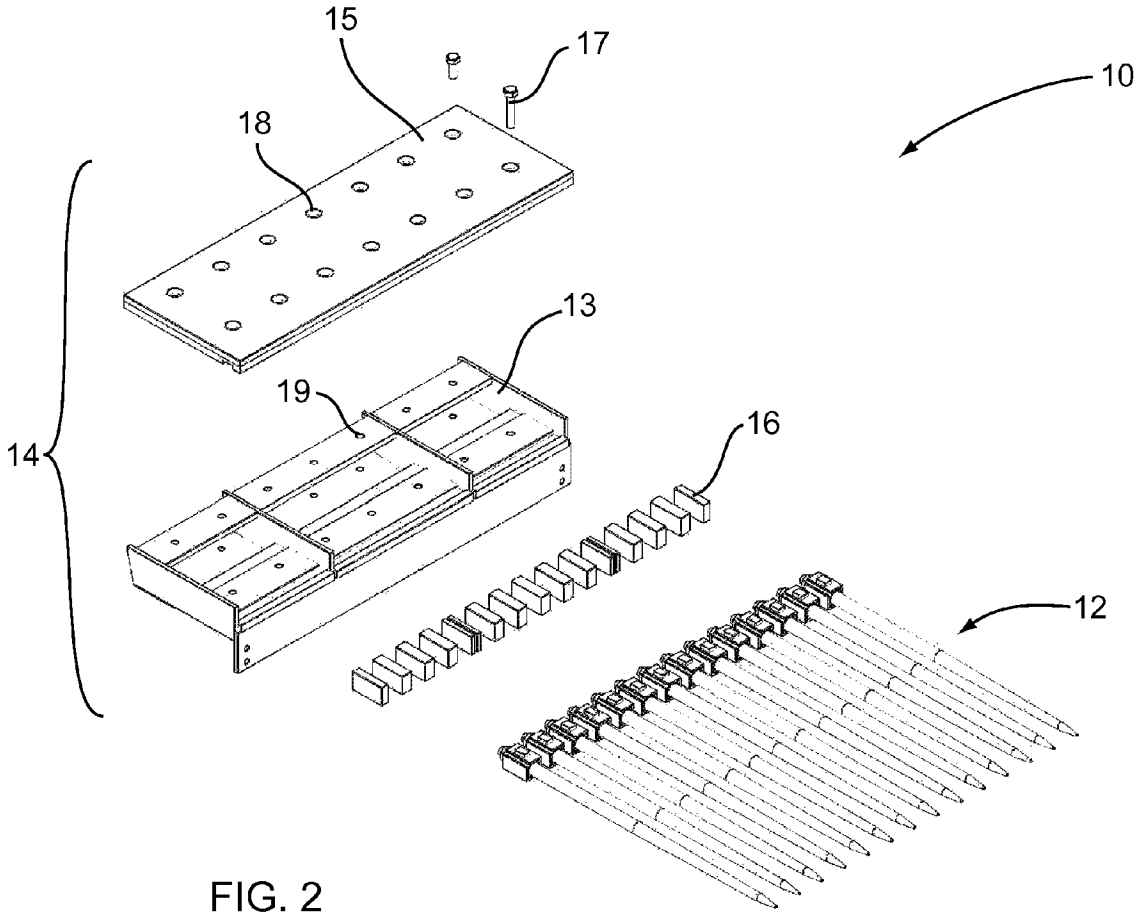
FIG. 2 is a perspective, exploded view of an adjustable spring grizzly bar material separator.
Figure 3:
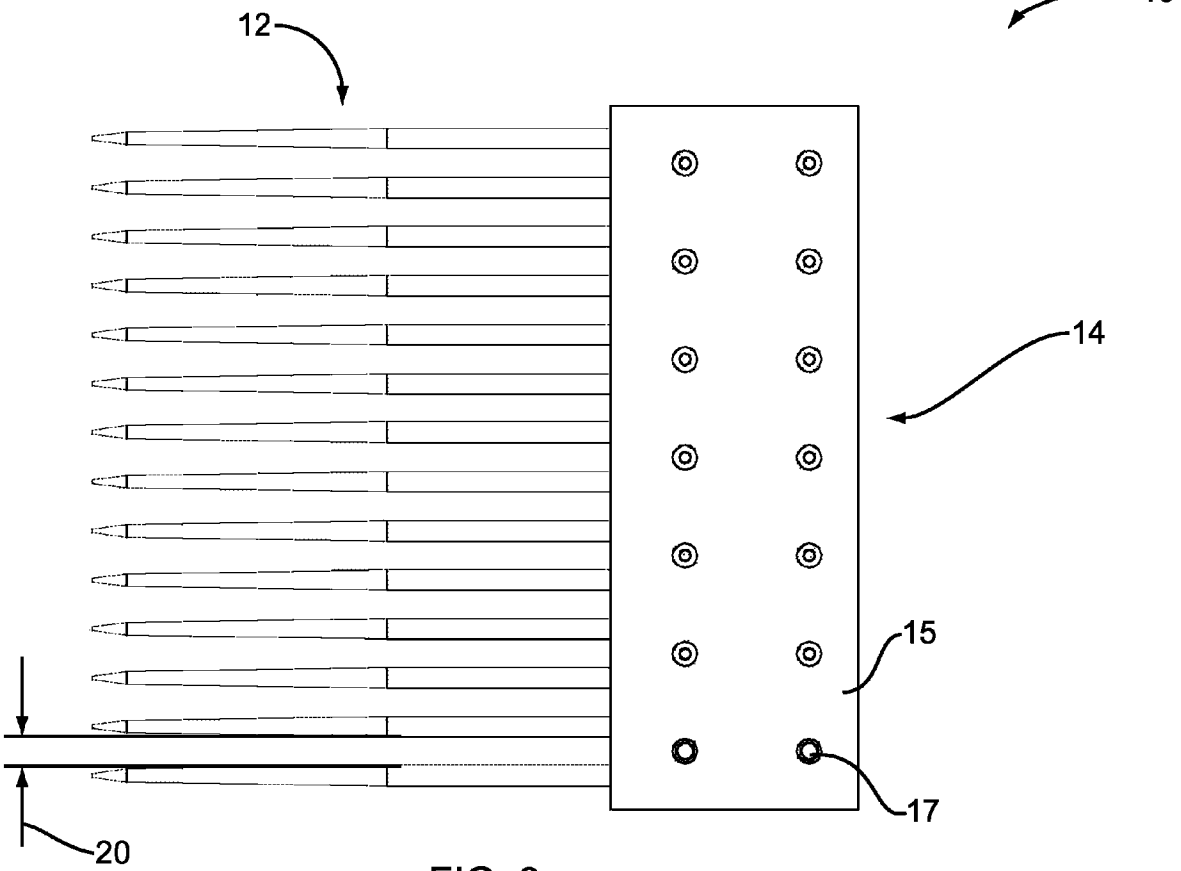
FIG. 3 is a top view of an adjustable spring grizzly bar material separator.
Figure 4:
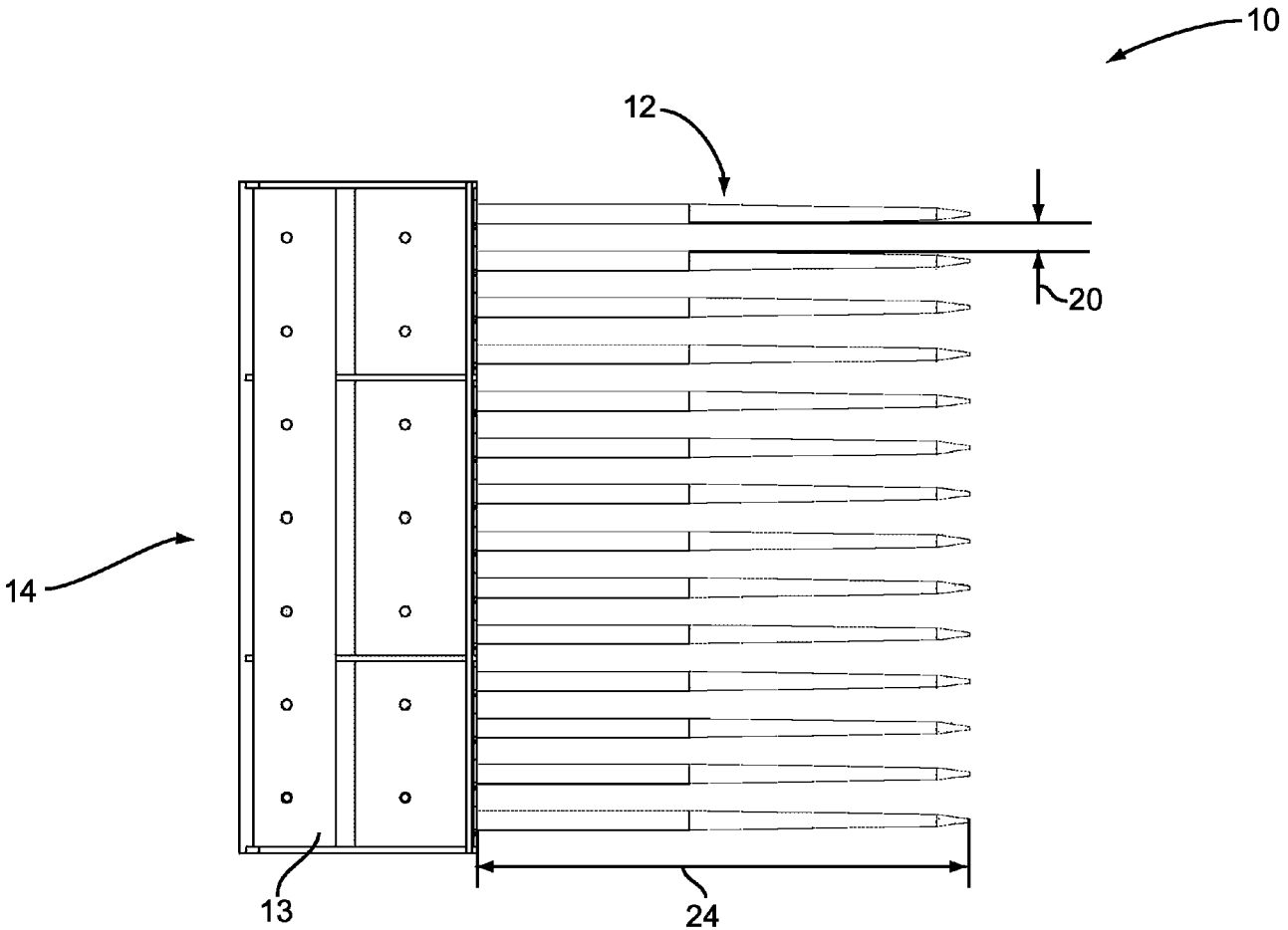
FIG. 4 is a bottom view of an adjustable spring grizzly bar material separator.
Figure 5:
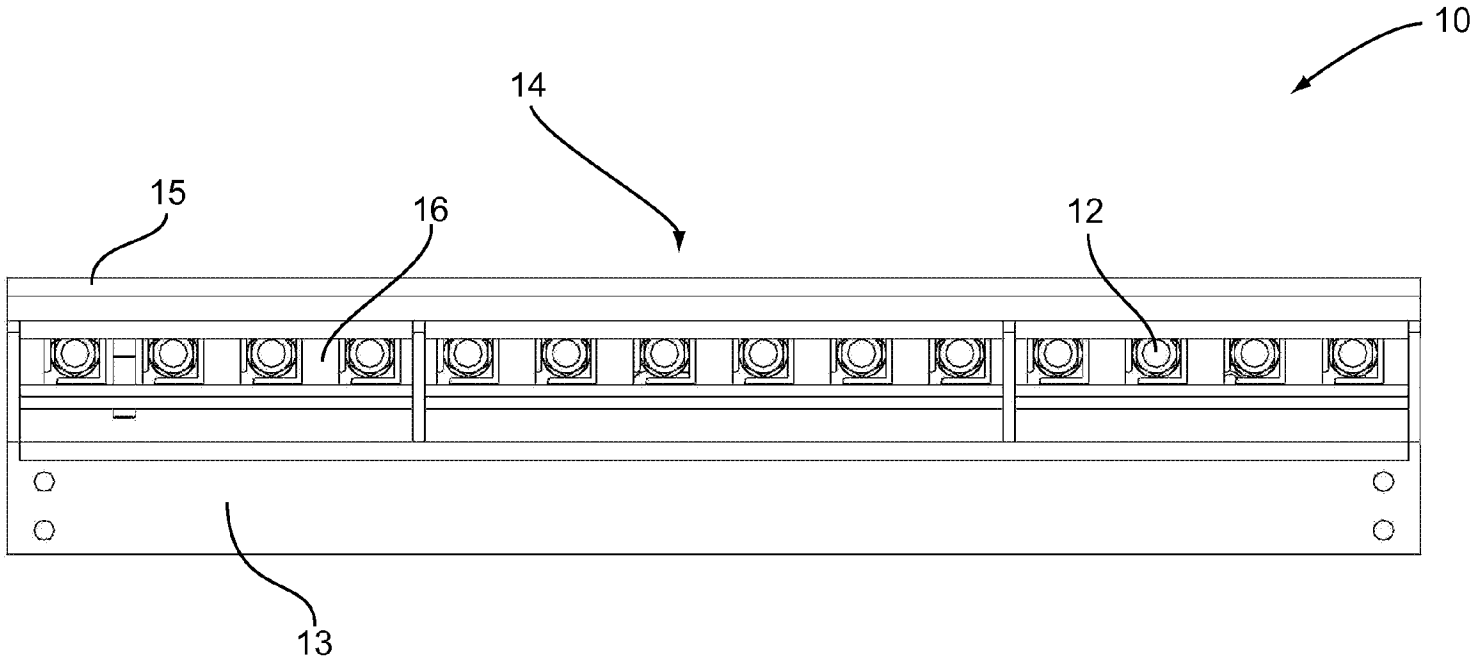
FIG. 5 is a back view of an adjustable spring grizzly bar material separator.

As discussed above, embodiments of the present invention relate to an adjustable spring grizzly bar material separator having a plurality of flexible tines, wherein the spacing between the tines is adjustable. The flexible tines are also flexible; thereby inhibiting the opportunity for material, such as rocks, to become lodged or otherwise stuck in the spaces between tines and obstructs the operation of the material separator.

Referring to the drawings, FIGS. 1-6 depict an embodiment of an adjustable spring grizzly bar material separator 10. The material separator 10 comprises a plurality of flexible tines 12, a cassette 14 and a plurality of spacers 16. The plurality of flexible tines 12 are each coupled on an end to the cassette 14. The plurality of spacers 16 are coupled within the cassette 14 between the plurality of flexible tines 12, wherein the spacers 16 separate the plurality of flexible tines 12 a predetermined distance 20 to set the size of material that is to be separated from an amount of aggregate flowing over the flexible tines 12. The flexible tines 12 may be formed of a spring steel or other strong, yet flexible material.

The cassette 14 comprises a base portion 13 and a securing plate 15. The securing plate 15 includes a plurality of apertures 18 that correspond to apertures 19 on the base portion 13. A securing device 17, such as a bolt, may extend through the aperture 18 of the securing plate, with the head of the bolt 17 engaging the securing plate 15, and the threaded portion engaging the aperture 19 of the base portion, wherein the securing device 17 removably couples the securing plate 15 to the base portion 13 of the cassette 14. The plurality of flexible tines 12 are coupled to the cassette 14 by supporting an end of the plurality of flexible tines 12 on the base portion 13 and removably securing the securing plate 15 to the base portion 13 of the cassette 14. This secures the plurality of flexible tines 12 at one end within the cassette 14. In at least this way, the plurality of flexible tines 12 is coupled on an end to the cassette 14.

The cassette 14 also removably secures a spacer 16 between two tines 12 of a plurality of flexible tines 12. For example, the base portion 13 of the cassette 14 supports the plurality of spacers 16, each spacer 16 between two tines 12 of the plurality of flexible tines 12.

Figure 9:
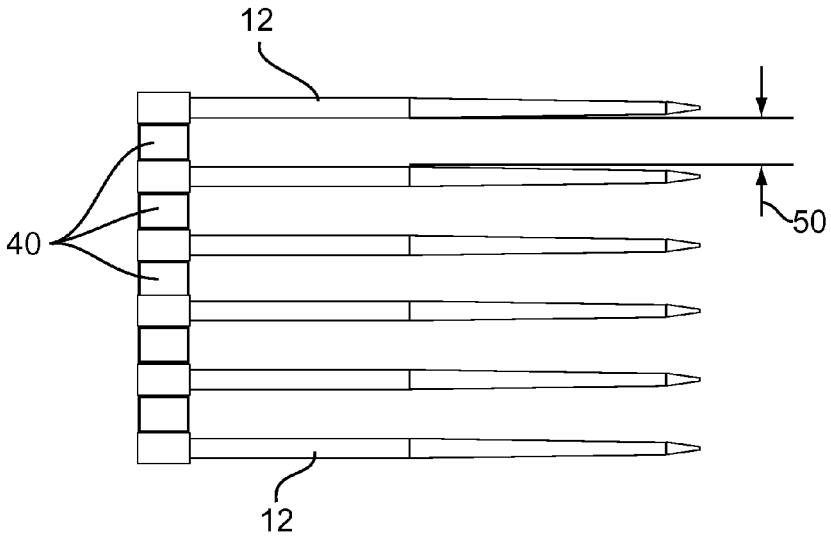
FIG. 9 is a top view of a plurality of flexible tines with a first set of spacers of an adjustable spring grizzly bar material separator.
Figure 10:
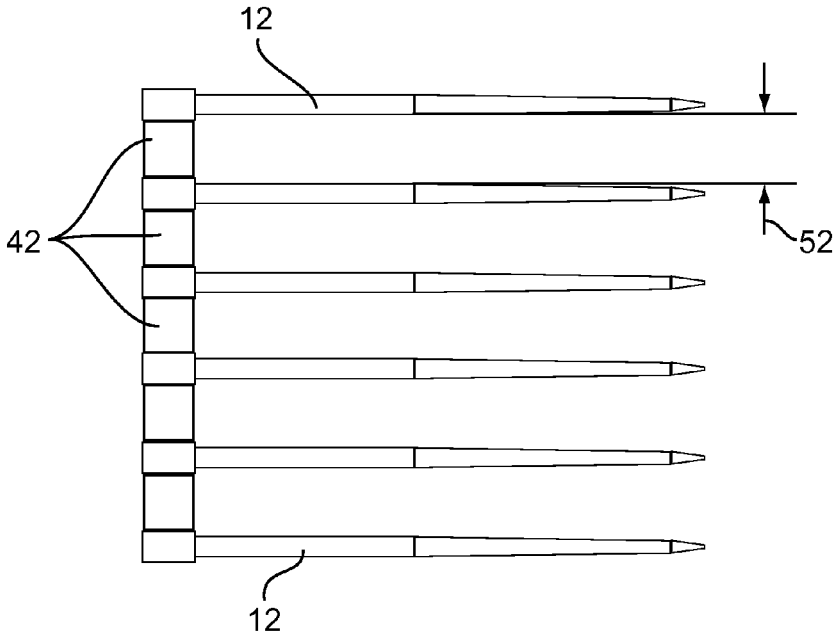
FIG. 10 is a top view of a plurality of flexible tines with a second set of spacers of an adjustable spring grizzly bar material separator.

With reference to FIGS. 9 and 10, and in accordance with some embodiments, the adjustable spring grizzly bar material separator 10 may also comprise a first set of spacers 40 removably coupled within the cassette 14 between the plurality of flexible tines 12, wherein the first set of spacers 40 separate the plurality of flexible tines 12 a first predetermined distance 50 to set the size of material that is to be separated from an amount of aggregate flowing over the tines 12. The embodiment may also comprise a second set of spacers 42, wherein the first set of spacers 40 is replaceable with the second set of spacers 42, wherein the second set of spacers 42 separates the plurality of flexible tines 12 a second predetermined distance 52, the second predetermined distance 52 being different from the first predetermined distance 50. In this at least this way, the material separator 10 is adjustable. It will be understood that various sized spacers may be used, wherein any length of spacing between tines 12 may be obtained by use spacers.

Figure 13:
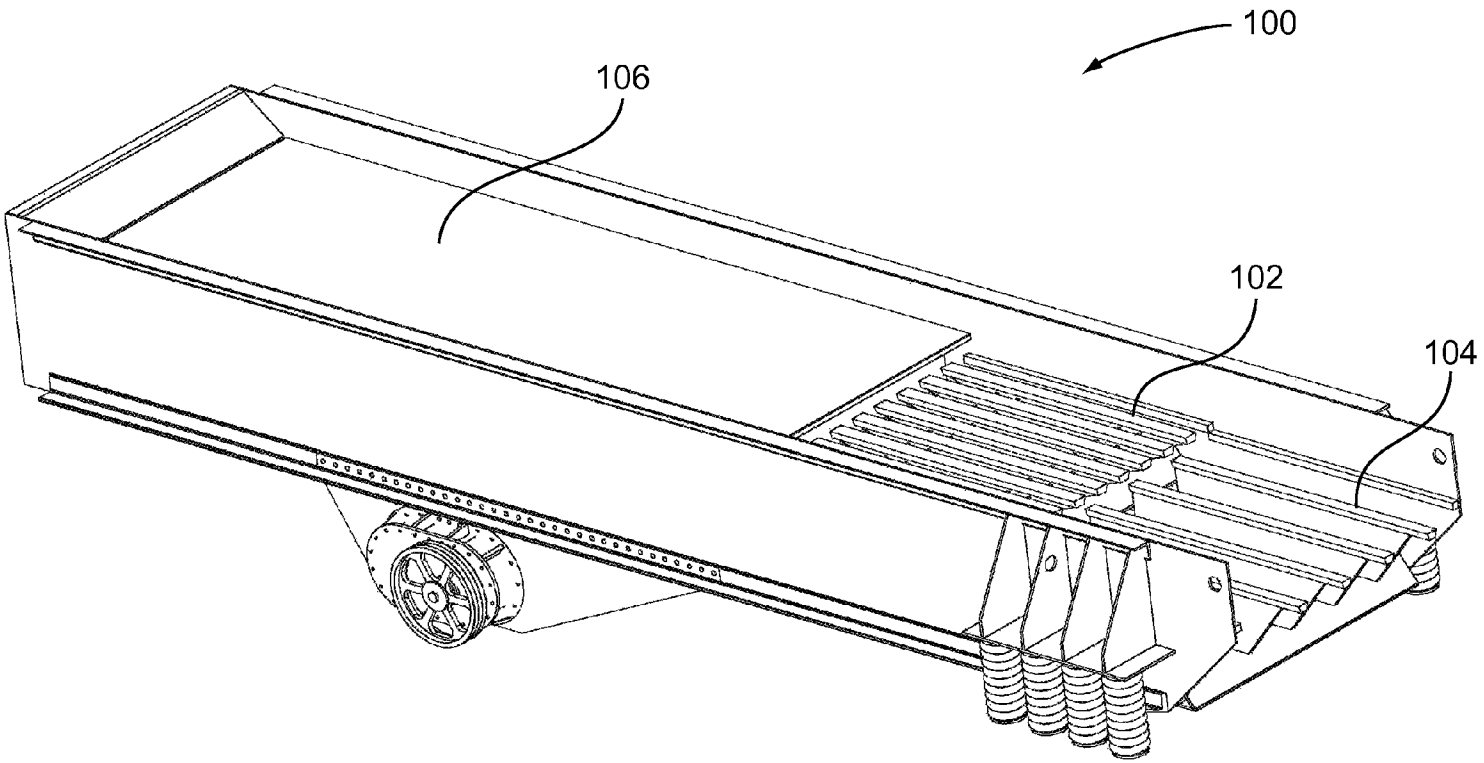
FIG.13 (PRIOR ART)
FIG. 13 is a perspective view of a prior art material separator.

Referring to FIG. 13, a prior art grizzly bar feeder 100 is provided, wherein grizzly bars 102 and 104 are coupled adjacent a vibratory plate feeder 106. The grizzly bars 102 and 104 a predetermined length and width. The bars 102 and 104 are secured and supported at at least two points along the length of the bars 102 and 104. The bars 102 and 104 are rigid and supported in a non-cantilevered configuration.

According to the invention, embodiments of the flexible rods 12 have a length of at least 30 inches. Further, some embodiment of the flexible rods 12 may have a length within the range of 30 inches to 36 inches. Other embodiments of the flexible rods 12 may have a length within the range of 30 to 48 inches. Additionally, other embodiments of the flexible rods 12 may have a length within the range of 30 to 54 inches. Further still, other embodiments of the flexible rods 12 may have a length within the range of 30 to 60 inches.

Figure 7:
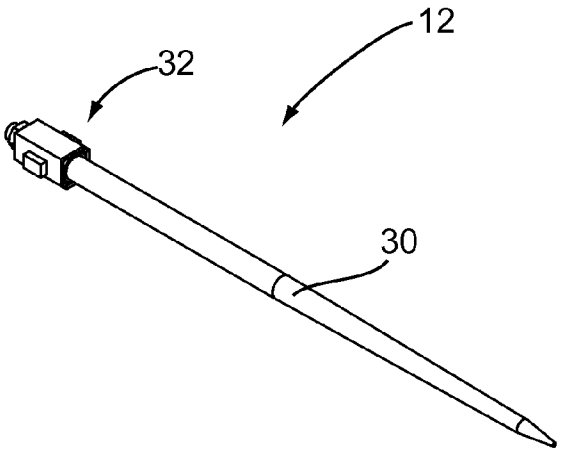
FIG. 7 is a perspective view of a flexible bar of an adjustable spring grizzly bar material separator.
Figure 8:
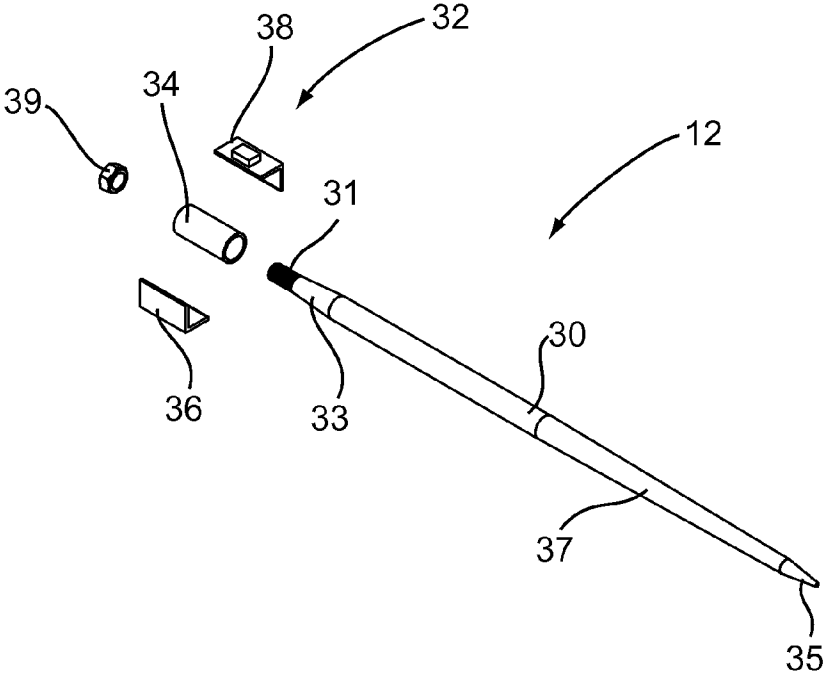
FIG. 8 is an exploded view of a flexible bar of an adjustable spring grizzly bar material separator.

With additional reference to the drawings, FIGS. 7 and 8 depict a flexible tine 12 according to embodiments of the present invention. In FIG. 8, the tine 12 comprises a rod section and a cassette connection device 32. The rod section 30 comprises a first end 31 that is threaded and a pointed second end 35. Further, the rod section 30 comprises a tapered end 33 and a tapered section 37. The tapered end 33 is adjacent the first end 31 and in some embodiments is a frustoconical shape. The tapered section 37 is adjacent to the pointed end 35, and in some embodiments is a frustoconical shape. The rod section 30 is formed of flexible. This allows for the rod section 30 to flex in spring like fashion in each direction.

While the above describes the shape of some of the tines 12 of the present invention, other embodiments have various shapes. For example and without limitation, the tines may be circular in cross section and not have tapers, other cross-sectional shapes include square, rectangular, triangular, and any other type of shape that form a tine.

The cassette connection device 32 may comprise a collar 34 that slides over the first end 31 of the rod portion 30. A nut 39 engages the first end 31 and secures the collar 34 on the rod portion 30. Brackets 36 and 38 may then be coupled around the collar, wherein the collar 34 has the proper diameter to engage each side of each bracket 36 and 38. The cassette connection device 32 provides a mechanism to easily place spacers 16 between the tines 12 and further allows of the cassette 14 to easily couple the end of the flexible tines 12 within the cassette 14.

It will be understood that in particular embodiments, the cassette connection device 32 may be integral with the first end of the flexible tine 12, shown in FIG. 7. In these embodiments, the tine and the connection device are formed as one single component and secured within the cassette 14.

Figure 14A:
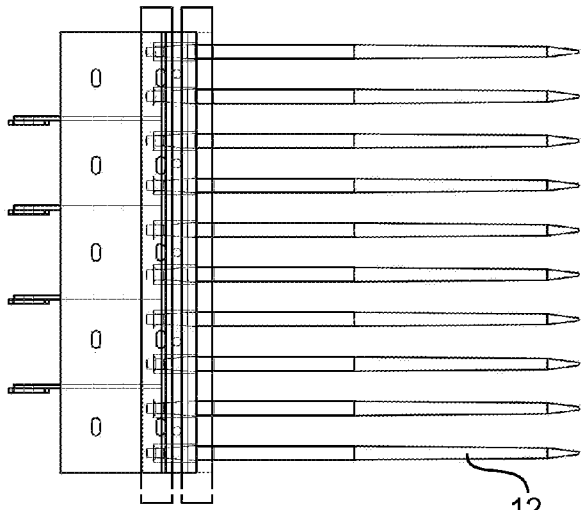
FIG. 14A is a top view of a spring grizzly bar material separator.
Figure 14B:
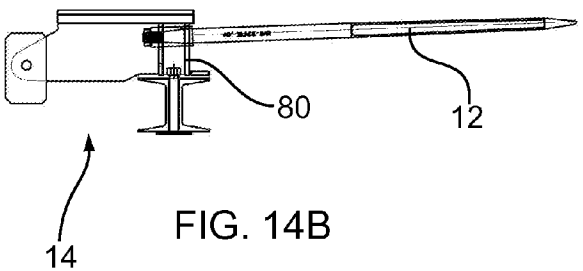
FIG. 14B is a side view of a spring grizzly bar material separator.
Figure 14C:
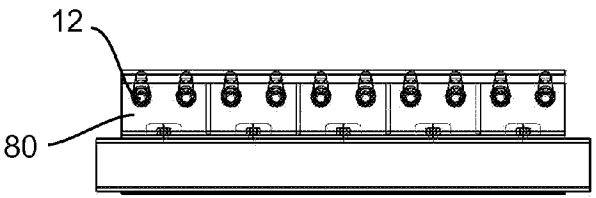
FIG. 14C is an end view of a spring grizzly bar material separator.

Other embodiments, as shown in FIGS. 14A-14C, include material separator device 10 having a plurality of flexible tines 12 coupled within a cassette 14. The device 10 comprises a spacer plate, wherein the plate includes a plurality of apertures, wherein the tines 12 extend through the apertures. To adjust the spacing between tines 12, a new spacing plate is used with apertures.

Figure 11:
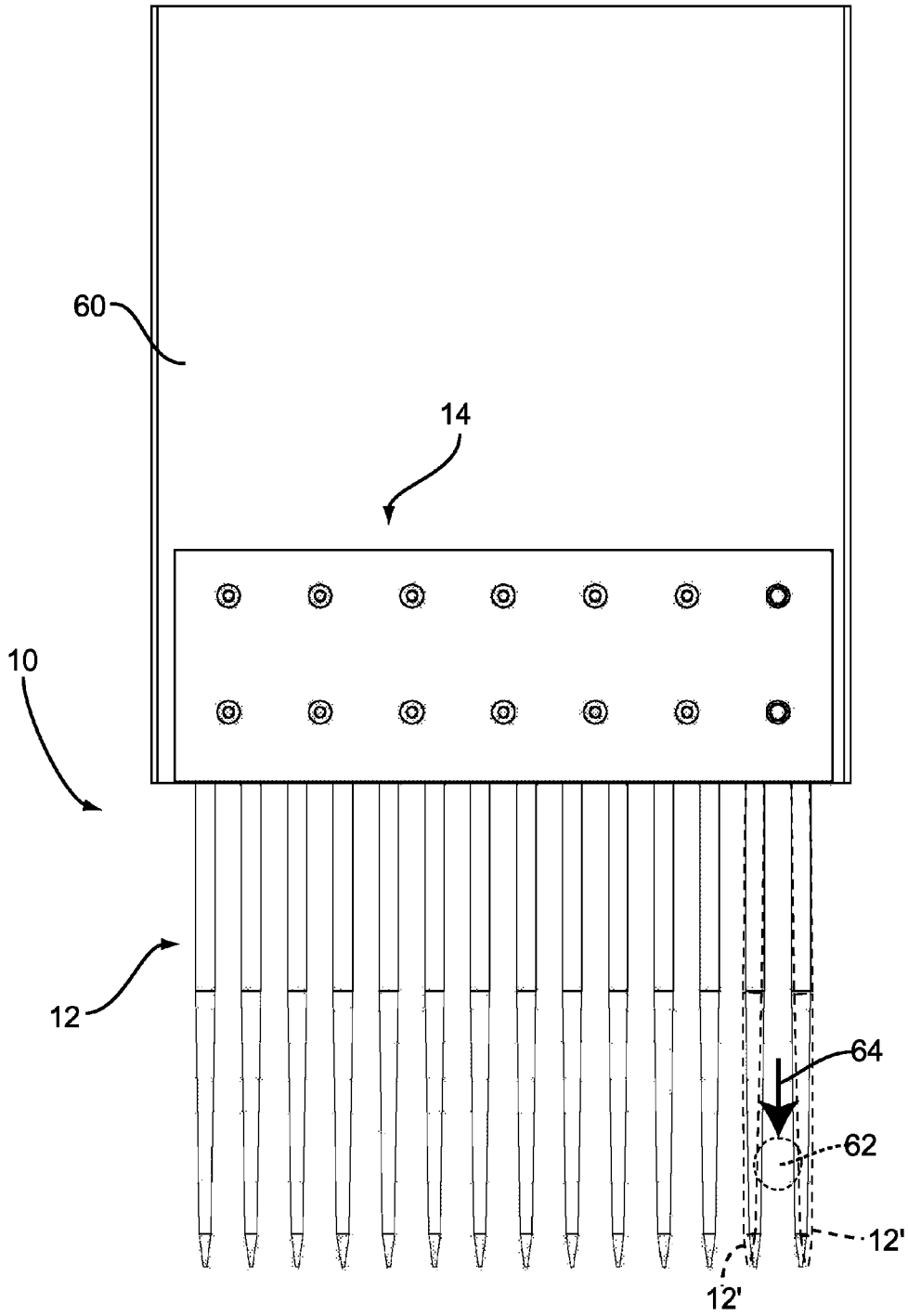
FIG. 11 is a top view of an adjustable spring grizzly bar material separator coupled adjacent a vibratory plate feeder.

Referring further to FIG. 11, particular embodiments of the present invention include the adjustable spring grizzly bar material separator 10 and a conveying apparatus 60, wherein the cassette 14 with the plurality of flexible tines 12 are rotatably coupled adjacent the conveying apparatus 60. Aggregate 62 is dumped onto the conveying apparatus 60 and the material separator 10. As the conveying apparatus 60 operates, it forces material onto the material separator 10. The conveying apparatus may be a vibratory plate feeder, a conveyor, and the like. During operation, a larger sized particle 62, such as a larger rock 62 that is greater than the spaces between the rods 12, will become temporarily lodged between two flexible tines 12. As force 64 is applied to the larger sized particle 62 by additional material being flowed over the tines 12, the force flexes the tines 12 into a flexed position as designated by dashed tines 12'. The flex of the tines 12 allow for the material to be loosened from the tines 12 and eventually removed from material separator 10. In at least this way, the flexible tines 12 flex in response to force applied to the flexible tines 12 from ongoing material flow over the tines 12. Accordingly, the flex in the flexible tines inhibits collection material between adjacent flexible tines.

Figure 6:
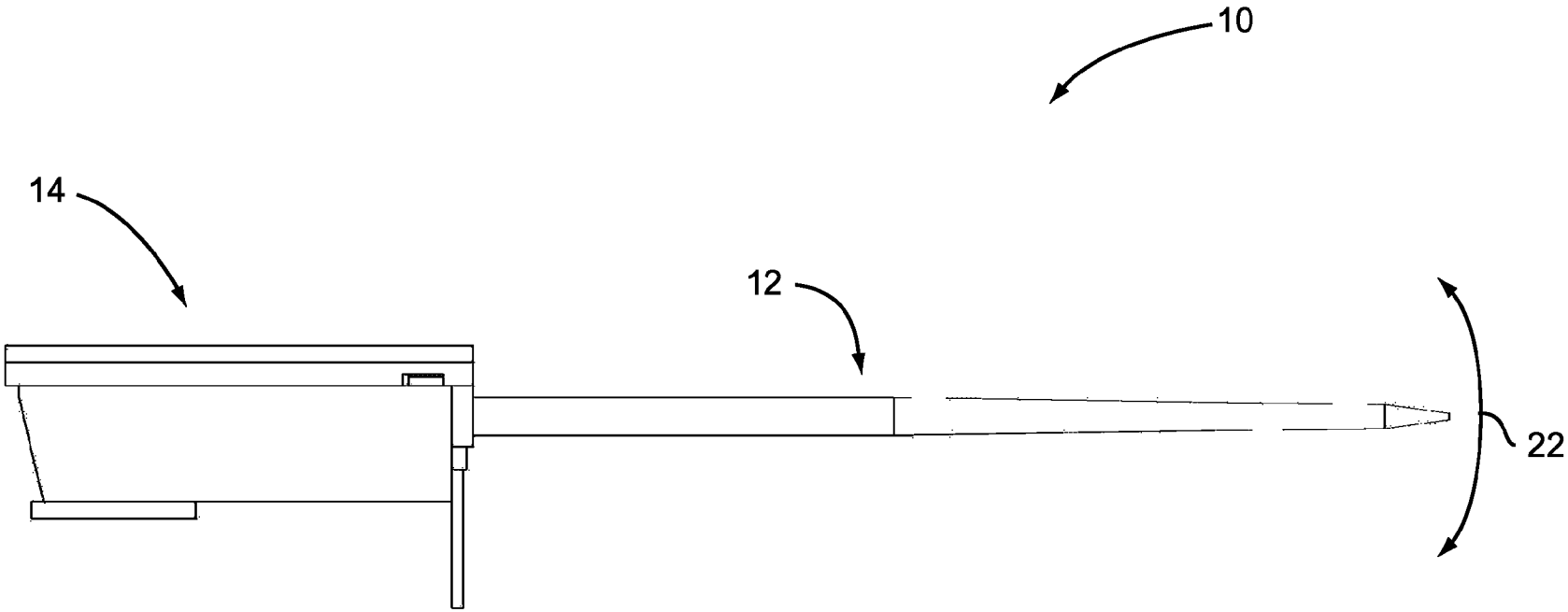
FIG. 6 is a side view of an adjustable spring grizzly bar material separator.

Referring further to the drawings, FIG. 6 depicts a side view of a material separator 10. The material separator 10 may be rotatably coupled adjacent a conveying apparatus 60, such as a vibratory plate feeder, a conveyor, and the like (See FIG. 11). The cassette 14 functions as the element of the material separator 10 that is coupled to the device carrying the vibratory plate feeder 60. The cassette 14 may be rotated through various angles as depicted by arrow 22, and coupled at varying angles adjacent the vibratory plate feeder 60. Accordingly the pitch of the plurality of flexible tines 12 is adjustable in response to rotation of the cassette 14.

In other embodiments, the cassette 14 functions as the element of the material separator 10 that is coupled to the device carrying the vibratory plate feeder 60. The cassette 14 may be held in a fixed position and the plurality of tines 12 may be secured in an adjustable track, wherein the tines are rotatable through various angles as depicted by arrow 22. The tines 12 may be rotated to the desired angle or pitch and then secured at that particular angle. Accordingly the pitch of the plurality of flexible tines 12 is adjustable in response to rotation tines 12 with respect to the cassette 14.

Figure 12:
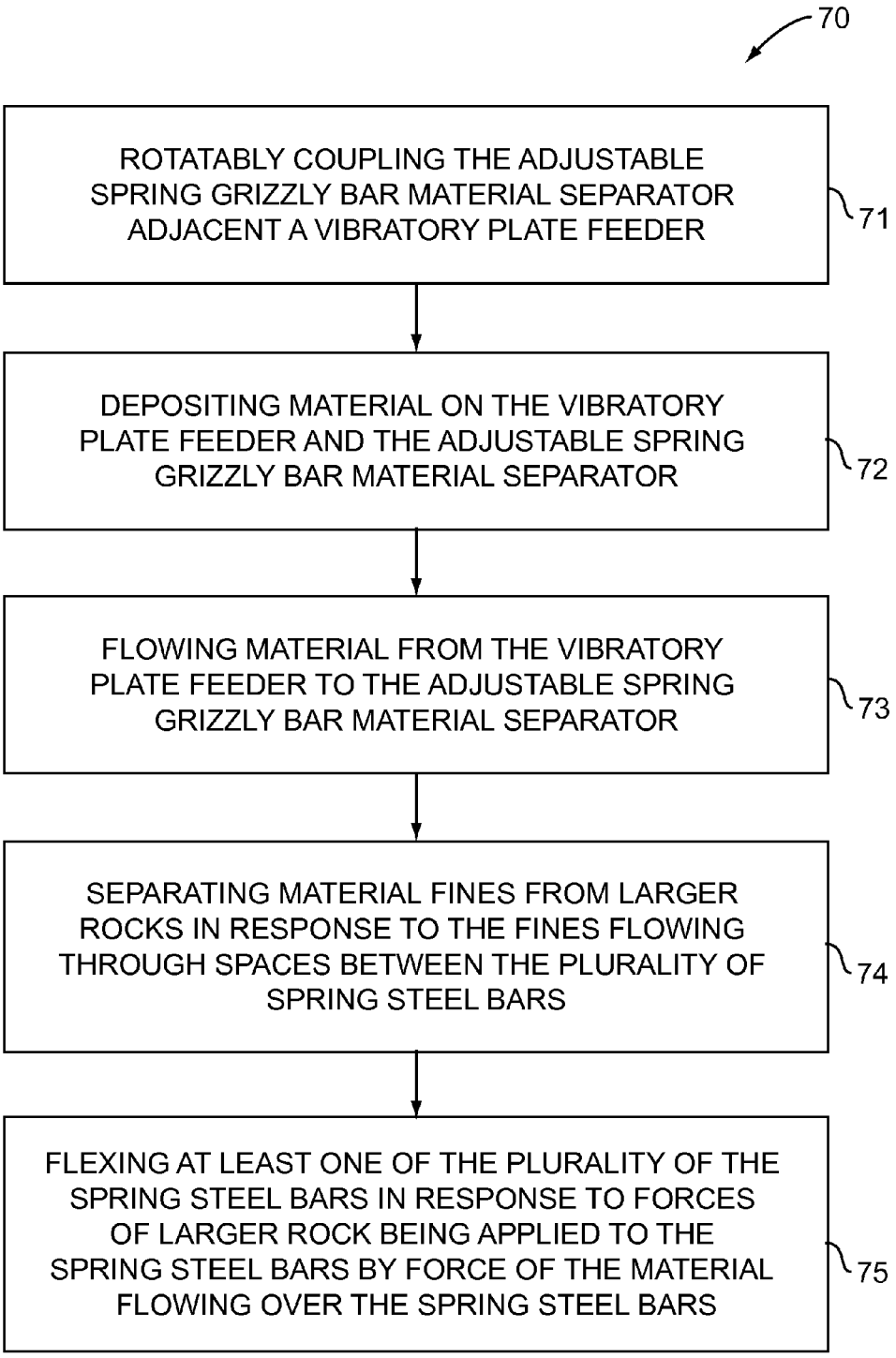
FIG. 12 is a flow chart of a method of using an adjustable spring grizzly bar material separator.

Another embodiment of the present invention, as shown in FIG. 12, includes a method 70 of using an adjustable spring grizzly bar material separator. The method 70 comprises rotatably coupling the adjustable spring grizzly bar material separator adjacent a vibratory plate feeder, the adjustable spring grizzly bar material separator comprising a plurality of flexible tines (Step 71); depositing material on the vibratory plate feeder and the adjustable spring grizzly bar material separator (Step 72); flowing material from the vibratory plate feeder to the adjustable spring grizzly bar material separator (Step 73); separating material fines from larger rocks in response to the fines flowing through spaces between the plurality of flexible tines of the adjustable spring grizzly bar material separator (Step 74); and flexing at least one of the plurality of the flexible tines in response to forces of larger rock being applied to the flexible tines by force of the material flowing over the flexible tines (Step 75).

The method may further comprise additional step. These steps may include adjusting space sizes between the plurality of flexible tines; and supporting an end of the flexible tines prior to adjusting the spaces between the plurality of flexible tines.

In some embodiments, adjusting the space sizes further comprises replacing a first set of spacers with a second set of spacers, wherein the second set of spacers separates the plurality of flexible tines a second predetermined distance, the second predetermined distance being different from a first predetermined distance associated with the first set of spacers.

Accordingly, the components of an adjustable spring grizzly bar material separator, with exception to materials of components already discussed having a particular material type, may be formed of any of many different types of materials or combinations thereof that can readily be formed into shaped objects provided that the components selected are consistent with the intended operation of an adjustable spring grizzly bar material separator. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any adjustable spring grizzly bar material separator may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner that allows the performance of the proper function of the component, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An adjustable spring grizzly bar material separator comprising:

a plurality of flexible tines;

a cassette, wherein the plurality of flexible tines are each coupled on an end to the cassette, and wherein the plurality of tines are separated a predetermined distance to set the size of material that is to be separated from an amount of aggregate flowing over the tines; and a plurality of spacers coupled within the cassette between the plurality of tines, wherein the spacers separate the plurality of flexible tines a predetermined distance to set the size of material that is to be separated from an amount of aggregate flowing over the tines.

2. The material separator of claim 1, further comprising a conveying apparatus, wherein the cassette with the plurality of flexible tines are coupled adjacent the conveying apparatus.

3. The material separator of claim 1, wherein the flexible tines flex in spring like fashion in each direction.

4. The material separator of claim 3, wherein the flexible tines flex in response to force applied to the flexible tines from ongoing material flow over the tines.

5. The material separator of claim 4, wherein the flex in the flexible tines inhibits collection material between adjacent flexible tines.

6. An adjustable spring grizzly bar material separator comprising:

a plurality of flexible tines;

a cassette, wherein the plurality of flexible tines are each coupled on an end to the cassette; and a first set of spacers removably coupled within the cassette between the plurality of tines, wherein the first set of spacers separate the plurality of flexible tines a first predetermined distance to set the size of material that is to be separated from an amount of aggregate flowing over the tines.

7. The material separator of claim 6, further comprising a second set of spacers, the first set of spacers is replaceable with the second set of spacers, wherein the second set of spacers separates the plurality of flexible tines a second predetermined distance, the second predetermined distance being different from the first predetermined distance.

8. The material separator of claim 7, further comprising a support structure removably coupled to the material separator to support ends of the plurality of flexible rods opposite of cassette, wherein the support structure supports the plurality of flexible rods in a substantially horizontal position during replacement of the first set of spacers with the second set of spacers.

9. The material separator of claim 6, wherein the flexible tines flex in spring like fashion in each direction.

10. The material separator of claim 9, wherein the flexible tines flex in response to force applied to the flexible tines from ongoing material flow over the tines.

11. The material separator of claim 10, wherein the flex in the flexible tines inhibits collection material between adjacent flexible tines.

12. The material separator of claim 6, further comprising a vibratory plate feeder, wherein the cassette with the plurality of flexible tines are rotatably coupled adjacent the vibratory plate feeder.

13. The material separator of claim 12, wherein the pitch of the plurality of flexible tines is adjustable in response to rotation of the cassette.

14. The material separator of claim 6, wherein the length of the plurality of rods is at least 30 inches.

15. A method of using an adjustable spring grizzly bar material separator, the method comprising:

coupling the adjustable spring grizzly bar material separator adjacent a vibratory plate feeder, the adjustable spring grizzly bar material separator comprising a plurality of flexible tines;

depositing material on the vibratory plate feeder and the adjustable spring grizzly bar material separator;

flowing material from the vibratory plate feeder to the adjustable spring grizzly bar material separator;

separating material fines from larger rocks in response to the fines flowing through spaces between the plurality of flexible tines of the adjustable spring grizzly bar material separator;

flexing at least one of the plurality of the flexible tines in response to forces of larger rock being applied to the flexible tines by force of the material flowing over the flexible tines;

adjusting space sizes between the plurality of flexible tines;

supporting an end of the flexible tines prior to adjusting the spaces between the plurality of flexible tines; and adjusting the space sizes further comprises replacing a first set of spacers with a second set of spacers, wherein the second set of spacers separates the plurality of flexible tines a second predetermined distance, the second predetermined distance being different from a first predetermined distance associated with the first set of spacers.

* * * * *